US006380142B1

(12) United States Patent
Vogt et al.

(10) Patent No.: US 6,380,142 B1
(45) Date of Patent: Apr. 30, 2002

(54) STORAGE-STABLE FORMULATIONS COMPRISING MEDIATORS, PEROXIDE COMPOUNDS AND PH STABILIZERS AND THEIR USE IN ENZYMATIC BLEACHING SYSTEMS

(75) Inventors: Uwe Vogt, Monheim; Markus Schindler, Emden, both of (DE)

(73) Assignee: Bayer Aktiengesellschaft, Leverkusen (DE)

( * ) Notice: Subject to any disclaimer, the term of this patent is extended or adjusted under 35 U.S.C. 154(b) by 29 days.

(21) Appl. No.: 09/678,599

(22) Filed: Oct. 4, 2000

(30) Foreign Application Priority Data

Oct. 12, 1999 (DE) ..... 199 48 989

(51) Int. Cl.[7] ..... C11D 7/32; C11D 7/38; C11D 7/54

(52) U.S. Cl. ..... 510/303; 510/309; 510/372; 510/500; 548/259; 548/302; 548/304.4; 548/361.1; 548/469; 252/186.29; 252/186.31; 252/186.39

(58) Field of Search ..... 548/259, 302, 548/304.4, 361.1, 469; 510/303, 309, 372, 500; 252/186.29, 186.31, 186.39

(56) References Cited

U.S. PATENT DOCUMENTS 5,376,387 A 12/1994 Monticello ..... 424/616
6,048,367 A 4/2000 Damhus et al. ..... 8/111
6,248,134 B1 * 6/2001 Damhus et al. ..... 8/111

FOREIGN PATENT DOCUMENTS

| | | |
|---|---|---|
| CA | 2239591 | 6/1998 |
| DE | 197 23 912 | 12/1998 |
| EP | 0 705 327 | 4/2000 |
| WO | 92/18687 | 10/1992 |

OTHER PUBLICATIONS

Journal of Biotechnology, vol. 53, (month unavailable) 1997, pp. 163–202, Call et al, No Month Available.

Database Chemabs 'Online! Chemical Abstracts Service, Columbus, OH, US; Retrieved from STN (Mar. 2000).

Database Accession No. 132:75263 CA XP002157750, Zusammenfassung, & Biologija (1998) (4), 32–36, J. Kulys, "Exploring and Modelling Mediator–Assisted Peroxidase Catalysis" (Apr. 1998).

* cited by examiner

*Primary Examiner*—Gregory Delcotto
(74) *Attorney, Agent, or Firm*—Joseph C. Gil; Richard E. L. Henderson

(57) ABSTRACT

The invention relates to novel storage-stable formulations containing at least one peroxide compound, at least one specific mediator, and at least one pH stabilizer. The invention further relates to the use of such storage-stable formulations as a component in enzymatic two-component bleaching systems.

8 Claims, No Drawings

STORAGE-STABLE FORMULATIONS COMPRISING MEDIATORS, PEROXIDE COMPOUNDS AND PH STABILIZERS AND THEIR USE IN ENZYMATIC BLEACHING SYSTEMS

BACKGROUND OF THE INVENTION

The invention relates to novel storage-stable formulations that comprise at least one peroxide compound, at least one mediator, and at least one pH stabilizer, to their preparation, and to their use in enzymatic bleaching systems, to specific enzymatic two-component bleaching systems, and to the use of such enzymatic bleaching systems.

The use of enzymatic bleaching systems is a method known to the person skilled in the art for the oxidative breakdown and/or for the alteration of wide varieties of substances. WO-A 92/18687 describes the decoloring of dyes, for example, as a field of application for such enzymatic bleaching systems. WO-A 94/29425, furthermore, discloses their use together with detersive substances. Moreover, enzymatic bleaching systems are much employed for pulp bleaching in the paper industry. See *Journal of Biotech.,* 53 163–202 (1997).

Enzymatic bleaching systems are multi-component systems and are commonly composed of an enzyme, an oxidant, an auxiliary component termed a mediator, and further additives such as, pH regulators or auxiliary mediators, for example. Frequently described mediators come from the group of the aliphatic, cycloaliphatic, heterocyclic and aromatic NO—, NOH—, or H—RN—OH-containing compounds. 1-Hydroxy-benzotriazole ("HOBT"), in particular, is widely mentioned as a mediator. Examples of oxidants are hydrogen peroxide itself or peroxide sources such as perborate, persulfate, or percarbonate.

WO-A 94/29425 describes, for example, a multi-component bleaching system for use with detersive substances, the system comprising an oxidation catalyst (in the form of an enzyme, for example), an oxidant, and a mediator. A common formulation in a washing solution is prepared from these three components.

WO-A 99/34054, furthermore, discloses a method of removing excess dye from a freshly dyed textile material. This method comprises treating the dyed textile material with a washing solution comprising at least one enzyme having laccase or peroxidase activity, an oxidant, at least one mediator, and, optionally, further additives. As far as the practical implementation of the method is concerned, it is merely stated that the said multi-component system is added to the washing solution in at least one of the washing steps. The state of the individual components is not critical; i.e., the individual components may each be used in the form of a solution, slurry, or granules. It is further stated that in one embodiment a common formulation of the two components enzyme and mediator is prepared in the form, for example, of a cogranulated formulation, a solution, or a slurry. In another embodiment, the multi-component system constitutes a mixture of granules, one granule component containing the enzyme, and another granule component containing the mediator. According to the examples of WO-A 99/34054, a preferred embodiment of the method comprises adding first a phosphate buffer to the wash liquor in one of the washing steps, then rinsing with this wash liquor for a certain time, and subsequently adding the components peroxidase, hydroxy-benzotriazole, and hydrogen peroxide, simultaneously but individually. This individual but simultaneous metered addition of the necessary components imposes stringent requirements on the accuracy and the moment of metered addition when the method is implemented on the industrial scale.

For optimum utilization of enzymatic bleaching it is therefore important in practice to control the process with exactitude in terms of the reaction conditions such as pH, temperature, moment of addition, and amounts of the components of the bleaching system. Precise observation of the process parameters is essential to successful bleaching. For example, even a local excess of hydrogen peroxide or a locally excessive pH leads to deactivation of the enzyme, which is synonymous with a reduction in or failure of the desired bleaching effect.

Against this background, in order to provide access for enzymatic bleaching systems to industrial application, i.e., to provide a product which is easy and reliable to use, it is necessary to bring the system comprising the above-mentioned individual components into an application-friendly form comprising as few components as possible.

In particular, liquid product forms are desirable since these can be metered precisely and reproducibly in automatic installations. Moreover, good stability on storage, including storage at relatively high temperatures, is an important factor for successful industrial deployment.

The object of the present invention was therefore to find storage-stable and application-friendly formulations of enzymatic bleaching systems for industrial use.

This object has been achieved by virtue of the provision of a common formulation comprising at least one mediator, at least one peroxide compound, and a pH stabilizer.

SUMMARY OF THE INVENTION

The invention provides aqueous formulations comprising, based on the overall formulation, (a) 0.1 to 20% by weight of at least one mediator comprising compounds of formula (I)

(I)

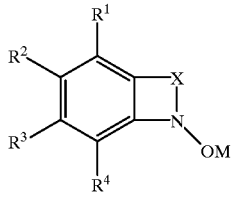

wherein

M denotes hydrogen, alkali metal (preferably sodium or potassium), alkaline earth metal (preferably calcium or magnesium), ammonium, $C_1$–$C_4$-alkylammonium, or $C_1$–$C_4$-alkanolammonium, the radicals $R^1$, $R^2$, $R^3$ and $R^4$ are identical or different and denote hydrogen, halogen (preferably fluorine, chlorine, or bromine), hydroxyl, formyl, amino, nitro, straight-chain or branched $C_1$–$C_{12}$-alkyl, straight-chain or branched $C_1$–$C_6$-alkoxy, carbonyl-$C_1$–$C_6$-alkyl, phenyl, benzyl, phenyloxy, —$COOR^5$, —$SO_2OR^5$, —$SO_2NH_2$, —$NHSO_2$, —$CONH_2$, —$PO(OR^5)_2$, —$PO_2(OR^5)$, or —$OPO(OR^5)_2$, X represents a group (—N═N—), $(—N═CR^6—)_m$, $(—CR^6═N—)_m$, or $(—CR^7═CR^8—)_m$, m is 1 or 2, $R^6$, $R^7$ and $R^8$ are identical or different and denote hydrogen, halogen (preferably fluorine, chlorine, or bromine), hydroxyl, formyl, amino, nitro, straight-chain or branched $C_1$–$C_{12}$-alkyl, straight-chain or branched $C_1$–$C_6$-alkoxy, carbonyl-$C_1$–$C_6$-alkyl, phenyl, benzyl, phenyloxy, —$COOR^5$, —$SO_2OR^5$, —$SO_2NH_2$, —$NHSO_2$, —$CONH_2$, —$PO(OR^5)_2$, —$PO_2(OR^5)$, or —$OPO(OR^5)_2$, and each $R^5$ is identical or different and denotes hydrogen, alkali metal (preferably sodium or potassium), alkaline earth metal (preferably calcium or magnesium), ammonium, $C_1$–$C_4$-alkylammonium, $C_1$–$C_4$-alkanolammonium, straight-chain or branched $C_1$–$C_{18}$-alkyl (preferably $C_2$–$C_{15}$-alkyl, especially $C_3$–$C_{10}$-alkyl), or the radical —$(CH_2—CH_2—O)_x$—H in which x denotes an integer 1 to 25 (preferably 2 to 20, more preferably 3 to 15), (b) 0.1 to 20% by weight of at least one peroxide compound, and (c) 60 to 99.8% by weight of an aqueous solution of at least one pH stabilizer, wherein the formulations contain no enzymes.

DETAILED DESCRIPTION OF THE INVENTION

The common formulations of components (a), (b), and (c) of the invention exhibit an unexpectedly good storage stability. This is particularly surprising in view of the fact that it is known that peroxide compounds in aqueous formulations generally exhibit poor storage stabilities. Especially at relatively high storage temperatures, degradation occurs more or less rapidly and is accompanied by oxygen elimination of the peroxide compounds. In order to retard the decomposition of the peroxide compounds during storage, it is already known from the prior art to add stabilizers such as sodium phosphates or complexing agents, for example, to aqueous peroxide formulations. However, the formulations of the invention exhibit a further unexpectedly improved storage stability relative to formulations that are stabilized solely with sodium phosphate.

The aqueous formulations of the invention comprise, based on the overall formulation, (a) preferably 0.1 to 10% by weight (with particular preference for 1 to 5% by weight) of at least one mediator comprising a compound of the above-mentioned formula (I), (b) preferably 0.1 to 10% by weight (with particular preference 1 to 8% by weight) of at least one peroxide compound, and (c) preferably 80 to 99.8% by weight (with particular preference 87 to 98% by weight) of an aqueous solution of at least one pH stabilizer, wherein the formulations contain no enzymes.

In the mediators of formula (I) used in the formulation of the invention, the radicals $R^1$ to $R^4$ may be substituted by one or more radicals $R^9$, wherein $R^9$ denotes hydrogen, halogen (preferably fluorine, chlorine, or bromine), hydroxyl, formyl, amino, nitro, straight-chain or branched $C_1$–$C_{12}$-alkyl, straight-chain or branched $C_1$–$C_6$-alkoxy, carbonyl-$C_1$–$C_6$-alkyl, phenyl, benzyl, phenyloxy, —$COOR^5$, —$SO_2OR^5$, —$SO_2NH_2$, —$NHSO_2$, —$CONH_2$, —$PO(OR^5)_2$, —$PO_2(OR^5)$, or —$OPO(OR^5)_2$, where $R^5$ has the definitions already stated for formula (I).

Preferred mediators used are hydroxybenzotriazole derivatives of formula (II)

(II)

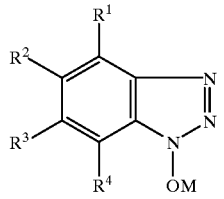

wherein

M denotes hydrogen, alkali metal (preferably sodium or potassium), alkaline earth metal (preferably calcium or magnesium), ammonium, $C_1$–$C_4$-alkylammonium, or $C_1$–$C_4$-alkanolammonium, the radicals $R^1$, $R^2$, $R^3$ and $R^4$ are identical or different and denote hydrogen, halogen (preferably fluorine, chlorine, or bromine), hydroxyl, formyl, amino, nitro, straight-chain or branched $C_1$–$C_{12}$-alkyl, straight-chain or branched $C_1$–$C_6$-alkoxy, carbonyl-$C_1$–$C_6$-alkyl, phenyl, benzyl, phenyloxy, —$COOR^5$, —$SO_2OR^5$, —$SO_2NH_2$, —$NHSO_2$, —$CONH_2$, —$PO(OR^5)_2$, —$PO_2(OR^5)$, or —$OPO(OR^5)_2$, each $R^5$ is identical or different and denotes hydrogen, alkali metal (preferably sodium or potassium), alkaline earth metal (preferably calcium or magnesium), ammonium, $C_1$–$C_4$-alkylammonium, $C_1$–$C_4$-alkanolammonium, straight-chain or branched $C_1$–$C_{18}$-alkyl (preferably $C_2$–$C_{15}$-alkyl, especially $C_3$–$C_{10}$-alkyl), or the radical —$(CH_2—CH_2—O)_x$—H in which x denotes an integer 1 to 25 (preferably 2 to 20, more preferably 3 to 15).

In the compounds of formula (II), as well, the radicals $R^1$ to $R^4$ may be substituted by one or more radicals $R^9$, where $R^9$ denotes hydrogen, halogen (preferably fluorine, chlorine, or bromine), hydroxyl, formyl, amino, nitro, straight-chain or branched $C_1$–$C_{12}$-alkyl, straight-chain or branched $C_1$–$C_6$-alkoxy, carbonyl-$C_1$–$C_6$-alkyl, phenyl, benzyl, phenyloxy, —$COOR^5$, —$SO_2OR^5$, —$SO_2NH_2$, —$NHSO_2$, —$CONH_2$, —$PO(OR^5)_2$, —$PO_2(OR^5)$, or —$OPO(OR^5)_2$, where $R^5$ has the definitions already stated for formula (I).

Examples of hydroxybenzotriazole derivatives of formula (II) are as follows:

1-Hydroxybenzotriazole
1-Hydroxybenzotriazole, sodium salt
1-Hydroxybenzotriazole, potassium salt
1-Hydroxybenzotriazole, lithium salt
1-Hydroxybenzotriazole, ammonium salt
1-Hydroxybenzotriazole, calcium salt
1-Hydroxybenzotriazole, magnesium salt
1-Hydroxybenzotriazole-4-sulfonic acid
1-Hydroxybenzotriazole-4-sulfonic acid, monosodium salt
1-Hydroxybenzotriazole-4-sulfonic acid, disodium salt
1-Hydroxybenzotriazole-4-sulfonic acid, monopotassium salt
1-Hydroxybenzotriazole-4-sulfonic acid, dipotassium salt
1-Hydroxybenzotriazole-5-sulfonic acid
1-Hydroxybenzotriazole-5-sulfonic acid, monosodium salt
1-Hydroxybenzotriazole-5-sulfonic acid, disodium salt
1-Hydroxybenzotriazole-5-sulfonic acid, monopotassium salt
1-Hydroxybenzotriazole-5-sulfonic acid, dipotassium salt
1-Hydroxybenzotriazole-6-sulfonic acid
1-Hydroxybenzotriazole-6-sulfonic acid, monosodium salt
1-Hydroxybenzotriazole-6-sulfonic acid, disodium salt
1-Hydroxybenzotriazole-6-sulfonic acid, monopotassium salt 1-Hydroxybenzotriazole-6-sulfonic acid, dipotassium salt
1-Hydroxybenzotriazole-7-sulfonic acid
1-Hydroxybenzotriazole-7-sulfonic acid, monosodium salt
1-Hydroxybenzotriazole-7-sulfonic acid, disodium salt
1-Hydroxybenzotriazole-7-sulfonic acid, monopotassium salt
1-Hydroxybenzotriazole-7-sulfonic acid, dipotassium salt
1-Hydroxybenzotriazole-4-carboxylic acid
1-Hydroxybenzotriazole-4-carboxylic acid, monosodium salt
1-Hydroxybenzotriazole-4-carboxylic acid, disodium salt
1-Hydroxybenzotriazole-4-carboxylic acid, monopotassium salt
1-Hydroxybenzotriazole-4-carboxylic acid, dipotassium salt
1-Hydroxybenzotriazole-5-carboxylic acid
1-Hydroxybenzotriazole-5-carboxylic acid, monosodium salt
1-Hydroxybenzotriazole-5-carboxylic acid, disodium salt
1-Hydroxybenzotriazole-5-carboxylic acid, monopotassium salt
1-Hydroxybenzotriazole-5-carboxylic acid, dipotassium salt
1-Hydroxybenzotriazole-6-carboxylic acid
1-Hydroxybenzotriazole-6-carboxylic acid, monosodium salt
1-Hydroxybenzotriazole-6-carboxylic acid, disodium salt
1-Hydroxybenzotriazole-6-carboxylic acid, monopotassium salt
1-Hydroxybenzotriazole-6-carboxylic acid, dipotassium salt
1-Hydroxybenzotriazole-7-carboxylic acid
1-Hydroxybenzotriazole-7-carboxylic acid, monosodium salt
1-Hydroxybenzotriazole-7-carboxylic acid, disodium salt
1-Hydroxybenzotriazole-7-carboxylic acid, monopotassium salt
1-Hydroxybenzotriazole-7-carboxylic acid, dipotassium salt
1-Hydroxybenzotriazole-6-N-phenylcarboxamide
5-Ethoxy-6-nitro-1-hydroxybenzotriazole
4-Ethyl-7-methyl-6-nitro-1-hydroxybenzotriazole
4,6-Bis(trifluoromethyl)-1-hydroxybenzotriazole-5-bromo-1-hydroxybenzotriazole
6-Bromo-1-hydroxybenzotriazole
4-Bromo-7-methyl-1-hydroxybenzotriazole
5-Bromo-7-methyl-6-nitro-1-hydroxybenzotriazole
4-Bromo-6-nitro-1-hydroxybenzotriazole
6-Bromo-4-nitro-1-hydroxybenzotriazole
4-Chloro-1-hydroxybenzotriazole
5-Chloro-1-hydroxybenzotriazole
6-Chloro-1-hydroxybenzotriazole
6-Chloro-5-isopropyl-1-hydroxybenzotriazole
5-Chloro-6-methyl-1-hydroxybenzotriazole
6-Chloro-5-methyl-1-hydroxybenzotriazole
4-Chloro-7-methyl-6-nitro-1-hydroxybenzotriazole
4-Chloro-5-methyl-1-hydroxybenzotriazole
5-Chloro-5-methyl-1-hydroxybenzotriazole
4-Chloro-6-nitro-1-hydroxybenzotriazole
4-Chloro-4-nitro-1-hydroxybenzotriazole
7-Chloro-1-hydroxybenzotriazole
6-Diacetylamino-1-hydroxybenzotriazole
4,6-Dibromo-1-hydroxybenzotriazole
4,6-Dichloro-1-hydroxybenzotriazole
5,6-Dichloro-1-hydroxybenzotriazole
4,5-Dichloro-1-hydroxybenzotriazole
4,7-Dichloro-1-hydroxybenzotriazole
5,7-Dichloro-6-nitro-1-hydroxybenzotriazole
5,6-Dimethoxy-1-hydroxybenzotriazole
4,6-Dinitro-1-hydroxybenzotriazole
5-Hydrazino-7-methyl-4-nitro-1-hydroxybenzotriazole
5,6-Dimethyl-1-hydroxybenzotriazole
4-Methyl-1-hydroxybenzotriazole
5-Methyl-1-hydroxybenzotriazole
6-Methyl-1-hydroxybenzotriazole
5-(1-Methylethyl)-1-hydroxybenzotriazole
4-Methyl-6-nitro-1-hydroxybenzotriazole
6-Methyl-4-nitro-1-hydroxybenzotriazole
5-Methoxy-1-hydroxybenzotriazole
6-Methoxy-1-hydroxybenzotriazole
7-Methyl-6-nitro-1-hydroxybenzotriazole
4-Nitro-1-hydroxybenzotriazole
6-Nitro-1-hydroxybenzotriazole
6-Nitro-4-phenyl-1-hydroxybenzotriazole
5-Phenylmethyl-1-hydroxybenzotriazole
4-Trifluoromethyl-1-hydroxybenzotriazole
5-Trifluoromethyl-1-hydroxybenzotriazole
6-Trifluoromethyl-1-hydroxybenzotriazole
4,5,6,7-Tetrachloro-1-hydroxybenzotriazole
4,5,6,7-Tetrafluoro-1-hydroxybenzotriazole
6-Tetrafluorethyl-1-hydroxybenzotriazole
4,5,6-Trichloro-1-hydroxybenzotriazole
4,6,7-Trichloro-1-hydroxybenzotriazole
6-Sulfamido-1-hydroxybenzotriazole
6-N,N-Diethylsulfamido-1-hydroxybenzotriazole
6-N-Methylsulfamido-1-hydroxybenzotriazole
6-(1H-1,2,4-Triazol-1-ylmethyl)-1-hydroxybenzotriazole
6-(5,6,7,8-Tetrahydroimidazo-[1,5-a]-pyridin-5-yl)-1-hydroxybenzotriazole
6-(Phenyl-1H-1,2,4-triazol-1-ylmethyl)-1-hydroxybenzotriazole
6-[(5-Methyl-1H-imidazol-1-yl)phenylmethyl]-1-hydroxybenzotriazole
6-[(4-Methyl-1H-imidazol-1-yl)phenylmethyl]-1-hydroxybenzotriazole
6-[(2-Methyl-1H-imidazol-1-yl)phenylmethyl]-1-hydroxybenzotriazole
6-(1H-Imidazol-1-yl-phenylmethyl)-1-hydroxybenzotriazole
5-(1H-Imidazol-1-yl-phenylmethyl)-1-hydroxybenzotriazole
6-[1-(1 H-Imidazol-1-yl)-ethyl]-1-hydroxybenzotriazole monohydrochloride All of the above-mentioned designations for the hydroxybenzotriazole derivatives that may be used in the formulations of the invention also include the tautomers in the form of the respective N-oxides.

The peroxide compounds used as component (b) of the formulations of the invention comprise hydrogen peroxide, hydrogen peroxide addition compounds such as peroxide-urea adducts, per-compounds such as perborates, percarbonates, or persulfates in the form of their alkali metal salts, or mixtures thereof.

The aqueous solutions of the pH stabilizers used as component (c) in the formulations of the invention comprise aqueous solutions of buffer salts such as alkali metal (preferably sodium or potassium), phosphates, citrates, acetates, formates, borates, or mixtures thereof. Such pH stabilizers exhibit a stabilizing activity within the pH range of optimum enzyme activity. The pH range of the aqueous solutions of the buffer salts is 3 to 9 (preferably 4 to 7 and with particular preference 5 to 6).

The concentrations of the buffer salts in the aqueous solution are situated in the range 0.5 to 2.0 mol/l (preferably in the range 0.8 to 1.8 mol/l). Likewise preferred is the range from 0.5 to 0.79 mol/l. Examples of suitable buffer salts are trisodium or tripotassium phosphate, disodium or dipotassium hydrogen phosphate, sodium or potassium dihydrogen phosphate, trisodium or tripotassium citrate, disodium or dipotassium citrate, monosodium or monopotassium citrate, sodium or potassium acetate, sodium or potassium formate, sodium or potassium tetraborate, or mixtures thereof.

In addition to components (a), (b), and (c), the aqueous formulations of the invention may comprise customary additives, examples being defoamers, surfactants, solubilizers such as glycols and polyethylene glycols, or water conditioners such as water softeners. Such additives are used at 0 to 20% by weight (preferably 0.5 to 15% by weight, with particular preference 1 to 10% by weight), based on the overall formulation.

The formulations of the invention are prepared by mixing the three components (a), (b), and (c) and, if used, the other additives in any desired sequence. It has proven to be suitable to use the mediator of the formula (I) and percompounds such as sodium perborate, for example, in solid form, whereas hydrogen peroxide is added as an aqueous solution. Hydrogen peroxide is usually used as an aqueous solution with a strength of 3 to 50% (preferably 30 to 40%). It has also proven to be suitable for the temperature of the formulation not to exceed 30° C. during mixing. The pH of the formulations of the invention is situated in the range 3 to 9 (preferably 4 to 7 and with particular preference 5 to 6).

The invention further provides for the use of the formulations of the invention as a component of enzymatic bleaching systems.

The invention also provides an enzymatic two-component bleaching system comprising as one component the above-described aqueous formulation and as second component at least one enzyme that exhibits peroxidase or laccase activity.

Examples of enzymes having peroxidase activity that may be used are the following: all peroxidases of enzyme classification (EC. 1.11.1.7), haloperoxidases such as chloride peroxidases (EC 1.11.1.10), for example, or any fragment or any synthetic or semisynthetic derivative thereof that exhibits peroxidase activity. Such enzymes are known and may be of microbial, vegetable, or animal origin.

In addition to the formulations of the invention, it is preferred in the two-component bleaching systems to use as the enzyme component those peroxidases that are prepared from plants (e.g., horseradish peroxidase or soya bean peroxidase) or by way of microorganisms such as bacteria or fungi, for example.

Some preferred fungi include strains belonging to the subgroup Deuteromycotina, class Hyphomycetes, such as, for example, Fusarium, Humicola, Trichoderma, Myrothecium, Verticillium, Arthromyces, Caldariomyces, Ulocladium, Embellisia, Cladosporium, or Dreschlera. Particular preference is given to *Fusarium oxysporum* (DSM 2672), *Humicola insolens, Trichoderma resii, Myrothecium verrucana* (IFO 6113), *Verticillium alboatrum, Verticillium dahlie, Arthromyces ramosus* (FERM P-7754), *Caldariomyces fumago, Ulocladium chartarum, Embellisia alli,* or *Dreschlera halodes.*

Other preferred fungi include strains belonging to the subgroup Basidiomycotina, class Basidiomycetes, such as Coprinus, Phanerochaete, Coriolus or Trametes, especially *Coprinus cinereus f. microsporus* (IFO 8371), *Coprinus macrorhizus, Phanerochaete chrysosporium* (e.g., NA-12), or Trametes such as *Trametes versicolor* (e.g., PR4 28-A), for example.

Fungi preferred for peroxidase preparation, furthermore, include strains belonging to the subgroup Zygomycotina, class Mycoraceae, such as Rhizopus or Mucor, for example, especially *Mucor hiemalis.*

Some preferred bacteria include strains of the Actinomycetales such as *Streptomyces spheroides* (ATTC 23965), *Streptomyces thermoviolaceus* (IFO 12382), or *Streptoverticillium verticillium* ssp. *verticillium.*

Other preferred bacteria are *Bacillus pumilus* (ATCC 12905), *Bacillus stearothermophilus, Rhodobacter sphaeroides, Rhodomonas palustri, Streptococcus lactis, Pseudomonas purrocinia* (ATCC 15958), and *Pseudomonas fluorescens* (NRRL B-11).

Further preferred bacteria include strains belonging to Myxococcus, such as *Myxococcus virescens,* for example.

The peroxidase may also be prepared by way of a process comprising the cultivation of a guest cell containing a recombinant DNA vector. This recombinant DNA vector, in turn, includes a DNA sequence that codes for the peroxidase and DNA sequences that permit the expression of the peroxidase-encoding DNA sequence. Cultivation takes place in a culture medium under conditions that permit the expression of the peroxidase. A particularly suitable peroxidase is a peroxidase prepared by means of recombinant DNA and derived from Coprinus sp., preferably *Coprinus macrorhizus* or *Coprinus cinereus,* as described in WO-A 92/16634.

It is also possible to use as the peroxidase component active fragments exhibiting peroxidase activity and derived from cytochromes, hemoglobin, or synthetic or semisynthetic derivatives thereof such as, for example, iron complexes of porphyrin or phthalocyanine or derivatives thereof.

In particular, reference may be made at this point as well to all enzymes exhibiting peroxidase activity and to the parent plants, fungi, and microorganisms, which are listed in WO-A 99/34054 on page 4, line 15, through page 6, line 2. The stated pages of WO-A 99134054 are therefore expressly incorporated by reference at this point.

Examples of enzymes having laccase activity that may be used are the following: all laccases of enzyme classification (EC 1.10.3.2), any catechol oxidase (EC 1.10.3.1), any bilirubin oxidase (EC 1.3.3.5), or any monophenol monooxygenase (EC 1.14.99.1). Such laccases of plant or microbial origin are known. The microbial laccases are derived from bacteria or fungi. Suitable examples include laccases derived from strains of Aspergillus, Neurospora, such as *Neurospora crassa,* for example, Podospora, Botrytis, Collybia, Fomes, Lentinus, Pleurotus, Trametes, such as *Trametes villosa* and *Trametes versicolor,* for example, Rhizoctonia, such as *Rhizoctonia solani,* for example, Coprinus, such as *Coprinus plicatilis* and *Coprinus cinereus,* for example, Psatyrella, Myceliophthora, such as *Myceliophthora thermophila,* for example, Schytalidium, Polyporus, such as *Polyporus pinsitus,* for example, Phlebia, such as *Phlebia radiata,* for example, or Coriolus, such as *Coriolus hirsutus,* for example. Particularly preferred laccases are those derived from strains of Fomes, Trametes, Rhizoctonia, Coprinus, Myceliophthora, Schytalidium, or Polyporus.

The laccase may further be prepared by a process comprising the cultivation of a guest cell containing a recombinant DNA vector. This DNA vector in turn includes a DNA sequence that codes for the laccase and DNA sequences that permit the expression of the laccase-encoding DNA sequence. Cultivation takes place in a culture medium under conditions that permit the expression of the laccase.

In particular, reference may be made at this point as well to all enzymes that exhibit laccase activity and also to the parent plants and microorganisms, which are listed in WO-A 99134054 on page 6, lines 4–31. The stated page of WO-A 99/34054, therefore, is expressly incorporated by reference at this point.

The invention additionally provides for the use of the enzymatic two-component bleaching system for decoloring dye in the wastewater, or for decoloring unbound, excess dye from textile materials after a dyeing operation, or for use in the washing of different-colored textiles in order to prevent unwanted mutual color transfer during the washing process, or for bleaching lignin-containing material, preferably in papermaking, or for treating wastewater from papermaking, or for the enzymatic polymerization of lignin-containing materials.

In all of these applications it is important that the two components of the two-component bleaching system are used in succession, although the sequence is not critical. Preferably, the aqueous formulation is added first, followed by the enzyme component.

Particular preference is given to the use of the formulations of the invention as a component of an enzymatic two-component bleaching system for decoloring excess, unbound dye from textile materials after a dyeing operation.

The invention therefore additionally provides a process for removing excess unbound dye from textile materials after a dyeing operation (preferably a reactive dyeing operation) comprising contacting the dyed material in one or more rinsing steps following the dyeing operation with the enzymatic two-component bleaching system, whereby the two components are added to the rinsing liquor in any order but in temporal succession.

The dyed textile materials may comprise natural materials, such as cotton, viscose, rayon, lyocell, wool, or silk, for example, or synthetic materials, such as polyester, nylon, or polyacrylonitrile, or blends of natural and synthetic materials. With particular preference, the dyed textile materials comprise cotton, viscose, and lyocell or blends thereof with polyester and nylon.

The process for removing the excess unbound dye is normally conducted at a temperature of 25 to 80° C. (preferably 40 to 60° C.). The pH in the rinsing liquor is situated in the range 3 to 9 (preferably 4 to 8 and with particular preference 5 to 7).

The enzyme is normally added in the form of an aqueous solution in an amount such that 0.005 to 5 mg (preferably 0.02 to 2 mg and with particular preference 0.05 to 1 mg) of enzyme per liter of rinsing liquor is present. The aqueous solution of the enzyme may optionally comprise other customary additives as well, such as monopropylene glycol, for example.

The formulation of the invention is added in an amount of 0.1 to 10 g (preferably 0.5 to 2.5 g) per liter of rinsing liquor.

With respect to the implementation of the process of the invention for removing the excess dye, it has proven appropriate first to add the aqueous formulation of the invention and only then, subsequently, when the aqueous formulation has become uniformly distributed in the wash liquor, to add the enzyme component as the second component. Through this mode of addition it is possible, surprisingly, to achieve a considerably greater oxidative breakdown of the dye in the wash liquor on industrial implementation than is possible with the process of WO-A 99/34054 in which the enzyme, the mediator, and the peroxide compound are added individually and simultaneously to the rinsing liquor. The method according to WO-A 99/34054 appears to lead to a deleterious deactivation of the enzyme.

The following examples further illustrate details for the preparation and use of the compositions of this invention. The invention, which is set forth in the foregoing disclosure, is not to be limited either in spirit or scope by these examples. Those skilled in the art will readily understand that known variations of the conditions and processes of the following preparative procedures can be used to prepare these compositions. Unless otherwise noted, all temperatures are degrees Celsius and all percentages are percentages by weight.

EXAMPLES

Example 1

85 g of an aqueous sodium phosphate buffer having a concentration of 0.8 mol/l and a pH of 5 were introduced into a vessel. In succession, first 5 g of sodium perborate tetrahydrate and then 5 g of hydroxybenzotriazole were introduced and the components were stirred at room temperature until dissolution was complete.

Examples 2–7

The formulations listed in Table 1 were prepared in analogy to Example 1.

Stability Testing

To assess the storage stability of the formulations, the samples were stored for a total of 7 days and 13 days, respectively, at 60° C. After 7 days and after 13 days, respectively, the residual peroxide compound content in the formulations was determined by iodometry. The results are summarized in Table 1 below.

The markedly higher storage stability of the formulations of the invention in comparison to the formulations containing no HOBT is evident.

TABLE 1

| Example | pH stabilizer | HOBT | $H_2O_2$ 35% strength | Na perborate tetrahydrate | Residual peroxide content in % after 7 days | Residual peroxide content in % after 13 days |
|---|---|---|---|---|---|---|
| 2 | 85 g sodium phosphate 0.8 mol/l // pH 5 | 5.0 g | — | 10 g | 59.6 | 38.6 |
| 3 | 94 g sodium phosphate 0.8 mol/l // pH 5 | 1.0 g | — | 5.0 g | 87.8 | 71.1 |
| 3 comp* | 95 g sodium phosphate 0.8 mol/l // pH 5 | — | — | 5.0 g | 9.0 | 10.7 |
| 4a | 90.5 g sodium phosphate 1.6 mol/l // pH 6 | 2.5 g | — | 7.0 g | 56.7 | 48.9 |

TABLE 1-continued

| Example | pH stabilizer | HOBT | $H_2O_2$ 35% strength | Na perborate tetrahydrate | Residual peroxide content in % after 7 days | 13 days |
|---|---|---|---|---|---|---|
| 4b | 94 g sodium phosphate 1.6 mol/l // pH 6 | 1.0 g | — | 5.0 g | 75.9 | 36.6 |
| 4 comp* | 95 g sodium phosphate 1.6 mol/l // pH 6 | — | — | 5.0 g | 9.0 | 4.5 |
| 5 | 92.5 g sodium phosphate 1.6 mol/l // pH 5 | 2.5 g | — | 5.0 g | 73.1 | 55.6 |
| 5 comp* | 95 g sodium phosphate 1.6 mol/l // pH 5 | — | — | 5.0 g | 30.8 | 6.6 |
| 6 | 92 g sodium phosphate 1.6 mol/l // pH 6 | 5.0 g | 3.0 g | — | 66.3 | 43.9 |
| 6 comp* | 97 g sodium phosphate 1.6 mol/l // pH 6 | — | 3.0 g | — | 9.3 | 6.1 |
| 7 | 96 g sodium phosphate 1.6 mol/l // pH 5 | 1.0 g | 3.0 g | — | 91.7 | 82.6 |
| 7 comp* | 97 g sodium phosphate 1.6 mol/l // pH 5 | — | 3.0 g | — | 26.1 | 9.1 |

*"comp" denotes comparative experiments

What is claimed is:

1. An aqueous formulation comprising, based on the overall formulation, (a) 0.1 to 20% by weight of at least one mediator comprising compounds of formula (I)

(I)

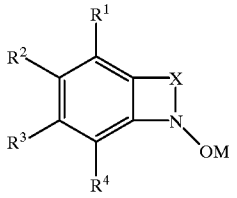

wherein

M denotes hydrogen, alkali metal, alkaline earth metal, ammonium, $C_1$–$C_4$-alkylammonium, or $C_1$–$C_4$-alkanolammonium, the radicals $R^1$, $R^2$, $R^3$ and $R^4$ are identical or different and denote hydrogen, halogen, hydroxyl, formyl, amino, nitro, straight-chain or branched $C_1$–$C_{12}$-alkyl, straight-chain or branched $C_1$–$C_6$-alkoxy, carbonyl-$C_1$–$C_6$-alkyl, phenyl, benzyl, phenyloxy, —$COOR^5$, —$SO_2OR^5$, —$SO_2NH_2$, —$NHSO_2$, —$CONH_2$, —$PO(OR^5)_2$, —$PO_2(OR^5)$, or —$OPO(OR^5)_2$, X represents a group (—N═N—), $(—N═CR^6—)_m$, $(—CR^6═N—)_m$, or $(—CR^7═CR^8—)_m$, m is 1 or 2, $R^6$, $R^7$ and $R^8$ are identical or different and denote hydrogen, halogen, hydroxyl, formyl, amino, nitro, straight-chain or branched $C_1$–$C_{12}$-alkyl, straight-chain or branched $C_1$–$C_6$-alkoxy, carbonyl-$C_1$–$C_6$-alkyl, phenyl, benzyl, phenyloxy, —$COOR^5$, —$SO_2OR^5$, —$SO_2NH_2$, —$NHSO_2$, —$CONH_2$, —$PO(OR^5)_2$, —$PO_2(OR^5)$, or —$OPO(OR^5)_2$, and each $R^5$ is identical or different and denotes hydrogen, alkali metal, alkaline earth metal, ammonium, $C_1$–$C_4$-alkylammonium, $C_1$–$C_4$-alkanolammonium, straight-chain or branched $C_1$–$C_{18}$ -alkyl, or the radical $—(CH_2—CH_2—O)_x—H$ in which x denotes an integer 1 to 25, (b) 0.1 to 20% by weight of at least one peroxide compound, and (c) 60 to 99.8% by weight of an aqueous solution containing at least one pH stabilizer, wherein the formulation contains no enzymes.

2. An aqueous formulation according to claim 1 comprising, based on the overall formulation, (a) 0.1 to 10% by weight of at least one mediator comprising compounds of formula (I), (b) 0.1 to 10% by weight of at least one peroxide compound, and (c) 80 to 99.8% by weight of an aqueous solution containing at least one pH stabilizer, wherein the formulation contains no enzymes.

3. An aqueous formulation according to claim 1 wherein the mediator is a hydroxybenzotriazole derivative of formula (II)

(II)

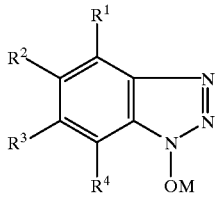

wherein

M denotes hydrogen, alkali metal, alkaline earth metal, ammonium, $C_1$–$C_4$-alkylammonium, or $C_1$–$C_4$-alkanolammonium, the radicals $R^1$, $R^2$, $R^3$ and $R^4$ are identical or different and denote hydrogen, halogen, hydroxyl, formyl, amino, nitro, straight-chain or branched $C_1$–$C_{12}$-alkyl, straight-chain or branched $C_1$–$C_6$-alkoxy, carbonyl-$C_1$–$C_6$-alkyl, phenyl, benzyl, phenyloxy, —$COOR^5$, —$SO_2OR^5$, —$SO_2NH_2$, —$NHSO_2$, —$CONH_2$, —$PO(OR^5)_2$, —$PO_2(OR^5)$, or —$OPO(OR^5)_2$, each $R^5$ is identical or different and denotes hydrogen, alkali metal, alkaline earth metal, ammonium, $C_1$–$C_4$-alkylammonium, $C_1$–$C_4$ -alkanolammonium, straight-chain or branched $C_1$–$C_{18}$-alkyl, or the radical —($CH_2$—$CH_2$—O)$_x$—H in which x denotes an integer 1 to 25.

4. An aqueous formulation according to claim 1 wherein the radicals $R^1$ to $R^4$ are substituted by one or more radicals $R^9$, wherein $R^9$ denotes hydrogen, halogen, hydroxyl, formyl, amino, nitro, straight-chain or branched $C_1$–$C_{12}$-alkyl, straight-chain or branched $C_1$–$C_6$-alkoxy, carbonyl-$C_1$–$C_6$-alkyl, phenyl, benzyl, phenyloxy, —$COOR^5$, —$SO_2OR^5$, —$SO_2NH_2$, —$NHSO_2$, —$CONH_2$, —$PO(OR^5)_2$, —$PO_2(OR^5)$, or —$OPO(OR^5)_2$, wherein each $R^5$ is identical or different and denotes hydrogen, alkali metal, alkaline earth metal, ammonium, $C_1$–$C_4$-alkylammonium, $C_1$–$C_4$-alkanolammonium, straight-chain or branched $C_1$–$C_{18}$-alkyl, or the radical —($CH_2$—$CH_2$—O)$_x$—H in which x denotes an integer 1 to 25.

5. An aqueous formulation according to claim 3 wherein the hydroxybenzotriazole derivative is at least one compound selected from the group consisting of 1-Hydroxybenzotriazole,
1-Hydroxybenzotriazole, sodium salt,
1-Hydroxybenzotriazole, potassium salt,
1-Hydroxybenzotriazole, lithium salt,
1-Hydroxybenzotriazole, ammonium salt,
1-Hydroxybenzotriazole, calcium salt,
1-Hydroxybenzotriazole, magnesium salt,
1-Hydroxybenzotriazole-4-sulfonic acid,
1-Hydroxybenzotriazole-4-sulfonic acid, monosodium salt,
1-Hydroxybenzotriazole-4-sulfonic acid, disodium salt,
1-Hydroxybenzotriazole-4-sulfonic acid, monopotassium salt,
1-Hydroxybenzotriazole-4-sulfonic acid, dipotassium salt,
1-Hydroxybenzotriazole-5-sulfonic acid,
1-Hydroxybenzotriazole-5-sulfonic acid, monosodium salt,
1-Hydroxybenzotriazole-5-sulfonic acid, disodium salt,
1-Hydroxybenzotriazole-5-sulfonic acid, monopotassium salt,
1-Hydroxybenzotriazole-5-sulfonic acid, dipotassium salt,
1-Hydroxybenzotriazole-6-sulfonic acid,
1-Hydroxybenzotriazole-6-sulfonic acid, monosodium salt,
1-Hydroxybenzotriazole-6-sulfonic acid, disodium salt,
1-Hydroxybenzotriazole-6-sulfonic acid, monopotassium salt,
1-Hydroxybenzotriazole-6-sulfonic acid, dipotassium salt,
1-Hydroxybenzotriazole-7-sulfonic acid,
1-Hydroxybenzotriazole-7-sulfonic acid, monosodium salt,
1-Hydroxybenzotriazole-7-sulfonic acid, disodium salt,
1-Hydroxybenzotriazole-7-sulfonic acid, monopotassium salt,
1-Hydroxybenzotriazole-7-sulfonic acid, dipotassium salt,
1-Hydroxybenzotriazole-4-carboxylic acid,
1-Hydroxybenzotriazole-4-carboxylic acid, monosodium salt,
1-Hydroxybenzotriazole-4-carboxylic acid, disodium salt,
1-Hydroxybenzotriazole-4-carboxylic acid, monopotassium salt,
1-Hydroxybenzotriazole-4-carboxylic acid, dipotassium salt,
1-Hydroxybenzotriazole-5-carboxylic acid,
1-Hydroxybenzotriazole-5-carboxylic acid, monosodium salt,
1-Hydroxybenzotriazole-5-carboxylic acid, disodium salt,
1-Hydroxybenzotriazole-5-carboxylic acid, monopotassium salt,
1-Hydroxybenzotriazole-5-carboxylic acid, dipotassium salt,
1-Hydroxybenzotriazole-6-carboxylic acid,
1-Hydroxybenzotriazole-6-carboxylic acid, monosodium salt,
1-Hydroxybenzotriazole-6-carboxylic acid, disodium salt,
1-Hydroxybenzotriazole-6-carboxylic acid, monopotassium salt,
1-Hydroxybenzotriazole-6-carboxylic acid, dipotassium salt,
1-Hydroxybenzotriazole-7-carboxylic acid,
1-Hydroxybenzotriazole-7-carboxylic acid, monosodium salt,
1-Hydroxybenzotriazole-7-carboxylic acid, disodium salt,
1-Hydroxybenzotriazole-7-carboxylic acid, monopotassium salt,
1-Hydroxybenzotriazole-7-carboxylic acid, dipotassium salt,
1-Hydroxybenzotriazole-6-N-phenylcarboxamide,
5-Ethoxy-6-nitro-1-hydroxybenzotriazole,
4-Ethyl-7-methyl-6-nitro-1-hydroxybenzotriazole,
4,6-Bis(trifluoromethyl)-1-hydroxybenzotriazole-5-bromo-1-hydroxy-benzotriazole,
6-Bromo-1-hydroxybenzotriazole,
4-Bromo-7-methyl-1-hydroxybenzotriazole,
5-Bromo-7-methyl-6-nitro-1-hydroxybenzotriazole,
4-Bromo-6-nitro-1-hydroxybenzotriazole,
6-Bromo-4-nitro-1-hydroxybenzotriazole,
4-Chloro-1-hydroxybenzotriazole,
5-Chloro-1-hydroxybenzotriazole,
6-Chloro-1-hydroxybenzotriazole,
6-Chloro-5-isopropyl-1-hydroxybenzotriazole,
5-Chloro-6-methyl-1-hydroxybenzotriazole,
6-Chloro-5-methyl-1-hydroxybenzotriazole,
4-Chloro-7-methyl-6-nitro-1-hydroxybenzotriazole,
4-Chloro-5-methyl-1-hydroxybenzotriazole,
5-Chloro-5-methyl-1-hydroxybenzotriazole,
4-Chloro-6-nitro-1-hydroxybenzotriazole,
4-Chloro-4-nitro-1-hydroxybenzotriazole,
7-Chloro-1-hydroxybenzotriazole,
6-Diacetylamino-1-hydroxybenzotriazole,
4,6-Dibromo-1-hydroxybenzotriazole,
4,6-Dichloro-1-hydroxybenzotriazole,
5,6-Dichloro-1-hydroxybenzotriazole,
4,5-Dichloro-1-hydroxybenzotriazole,
4,7-Dichloro-1-hydroxybenzotriazole,
5,7-Dichloro-6-nitro-1-hydroxybenzotriazole,
5,6-Dimethoxy-1-hydroxybenzotriazole,
4,6-Dinitro-1-hydroxybenzotriazole,
5-Hydrazino-7-methyl-4-nitro-1-hydroxybenzotriazole,
5,6-Dimethyl-1-hydroxybenzotriazole,
4-Methyl-1-hydroxybenzotriazole,
5-Methyl-1-hydroxybenzotriazole,
6-Methyl-1-hydroxybenzotriazole,
5-(1-Methylethyl)-1-hydroxybenzotriazole,
4-Methyl-6-nitro-1-hydroxybenzotriazole,
6-Methyl-4-nitro-1-hydroxybenzotriazole,
5-Methoxy-1-hydroxybenzotriazole,
6-Methoxy-1-hydroxybenzotriazole,
7-Methyl-6-nitro-1-hydroxybenzotriazole,
4-Nitro-1-hydroxybenzotriazole,
6-Nitro-1-hydroxybenzotriazole,
6-Nitro-4-phenyl-1-hydroxybenzotriazole,
5-Phenylmethyl-1-hydroxybenzotriazole,
4-Trifluoromethyl-1-hydroxybenzotriazole,
5-Trifluoromethyl-1-hydroxybenzotriazole,
6-Trifluoromethyl-1-hydroxybenzotriazole,
4,5,6,7-Tetrachloro-1-hydroxybenzotriazole,
4,5,6,7-Tetrafluoro-1-hydroxybenzotriazole,
6-Tetrafluorethyl-1-hydroxybenzotriazole, 4,5,6-Trichloro-1-hydroxybenzotriazole,
4,6,7-Trichloro-1-hydroxybenzotriazole,
6-Sulfamido-1-hydroxybenzotriazole,
6-N,N-Diethylsulfamido-1-hydroxybenzotriazole,
6-N-Methylsulfamido-1-hydroxybenzotriazole,
6-(1H-1,2,4-Triazol-1-ylmethyl)-1-hydroxybenzotriazole,
6-(5,6,7,8-Tetrahydroimidazo-[1,5-a]-pyridin-5-yl)-1-hydroxybenzotriazole,
6-(Phenyl-1H-1,2,4-triazol-1-ylmethyl)-1-hydroxybenzotriazole,
6-[(5-Methyl-1H-imidazol-1-yl)phenylmethyl]-1-hydroxybenzotriazole,
6-[(4-Methyl-1H-imidazol-1-yl)phenylmethyl]-1-hydroxybenzotriazole,
6-[(2-Methyl-1H-imidazol-1-yl)phenylmethyl]-1-hydroxybenzotriazole,
6-(1H-Imidazol-1-yl-phenylmethyl)-1-hydroxybenzotriazole,
5-(1H-Imidazol-1-yl-phenylmethyl)-1-hydroxybenzotriazole, and
6-[1-(1H-Imidazol-1-yl)-ethyl]-1-1-hydroxybenzotriazole monohydrochloride.

6. An aqueous formulation according to claim 1 wherein the peroxide compound is hydrogen peroxide, a hydrogen peroxide addition compound, a per-compound, or a mixture thereof.

7. An aqueous formulation according to claim 1 wherein the pH stabilizer is at least one buffer salt.

8. An aqueous formulation according to claim 1 wherein the pH stabilizer is an alkali metal phosphate, citrate, acetate, formate, borate or a mixture thereof.

* * * * *